US006042421A

United States Patent [19]

Stafford Gray et al.

[11] Patent Number: 6,042,421

[45] Date of Patent: Mar. 28, 2000

[54] COAXIAL CONNECTOR

[75] Inventors: Ian James Stafford Gray, Micheldever Station Nr Winchester; Ian Tilbury, Overton, both of United Kingdom

[73] Assignee: ITT Manufacturing Enterprises, Inc., Wilmington, Del.

[21] Appl. No.: 08/872,273

[22] Filed: Jun. 10, 1997

[51] Int. Cl.[7] ..... H01R 9/05

[52] U.S. Cl. ..... 439/578

[58] Field of Search ..... 439/578, 579, 439/581, 675, 944, 947, 346; 29/828

[56] References Cited

U.S. PATENT DOCUMENTS

| | | | |
|---|---|---|---|
| 4,426,127 | 1/1984 | Kubota | 439/578 |
| 4,767,360 | 8/1988 | Bonhomme | 439/593 |
| 4,964,814 | 10/1990 | Tengler et al. | 439/607 |
| 5,183,412 | 2/1993 | Nagafuji | 439/578 |
| 5,217,391 | 6/1993 | Fisher, Jr. | 439/578 |
| 5,439,394 | 8/1995 | Ikeda | 439/578 |

FOREIGN PATENT DOCUMENTS

| | | |
|---|---|---|
| 1218777 | 12/1968 | European Pat. Off. . |
| 0450988 A1 | 1/1991 | European Pat. Off. . |
| 2074798 | 4/1981 | United Kingdom . |
| 2160371 | 6/1984 | United Kingdom . |
| WO87/02196 | 4/1987 | WIPO . |
| WO96/32763 | 10/1996 | WIPO . |

*Primary Examiner*—Paula Bradley
*Assistant Examiner*—Tho D. Ta
*Attorney, Agent, or Firm*—Thomas L. Peterson

[57] ABSTRACT

A coax unit with outer and inner coaxial terminals (21, 22), is held in a housing passageway (11) by coupling elements (14). Each coupling element is formed of sheet metal and lies in the passageway beside the coax unit. The housing passageway has a cross-section that includes opposite part cylindrical sides (56) that are each parts of an imaginary cylinder (59), and has bottom and top extensions (12, 13) that extend beyond the imaginary cylinder. The coax unit is closely positioned by the part cylindrical sides. Each coupling element has a rear portion with a tongue (17) that presses against the coax unit, and each coupling unit forms a finger with a forward portion (60) having a contacting location (62) that presses against a coax mating device (32) that is inserted into the passageway, to electrically connect the outer terminals of the coax unit and of the mating device.

11 Claims, 5 Drawing Sheets

COAXIAL CONNECTOR

CROSS REFERENCE

This is a continuation-in-part of International Application PCT/GB95/02506 which was filed on Oct. 24, 1995 claiming priority of a first filed United Kingdom application no. 9425014.9 filed Dec. 12, 1994.

BACKGROUND OF THE INVENTION

Coaxial connectors include coaxial inner and outer terminals, and two of such connectors are mated by their inner terminals mating and their outer terminals mating. One common prior art approach includes forming the outer terminal of one connector so it has slits forming tines that could surround and press against the outer terminal of the other connector. FIG. 1 shows such a situation, where the inner terminals 1, 2 of a pair of connectors can mate while their outer terminals 3, 4 mate, by providing slits 5 in the outer terminal that form tines 6. The formation of tines in a seamless and resilient outer terminal increases its cost and requires a long length along which the slitted portion of the outer terminal enters the mating connector. Additionally, the force with which the slitted outer terminal will grip the other outer terminal may be high and require firm fixing of the mating outer terminal 4 to assure that it does not move. A coaxial connector system which enables simple coaxial units with outer and inner terminals, to mate and to be held in their connector housings, would be of value.

SUMMARY OF THE INVENTION

In accordance with one embodiment of the present invention, a coaxial connector that includes a coax unit with outer and inner terminals is provided, which enables reliable mating of the coax unit with a mating device, where the coax connector is of simple construction. The coax unit lies in a passageway of a coaxial connector housing. One or more sheet metal electrically conductive coupling elements lie in the passageway beside the coax unit. Each coupling element has a rear portion that presses against the outer terminal of the coax unit and against passageway walls. Each coupling element has a forward portion that extends forwardly and at a radially inward incline toward the axis of the passageway, to engage an outer terminal part of a mating device.

The passageway has a cross-section that includes opposite part cylindrical sides that are each part of an imaginary cylinder that closely receives the cylindrical coax unit. The passageway also includes one or more extensions that extend radially beyond the imaginary cylinder, with each coupling element lying primarily in one of the extensions.

The novel features of the invention are set forth with particularity in the appended claims. The invention will be best understood from the following description when read in conjunction with the accompanying drawings.

DESCRIPTION OF THE PREFERRED EMBODIMENT

Figure 1A:
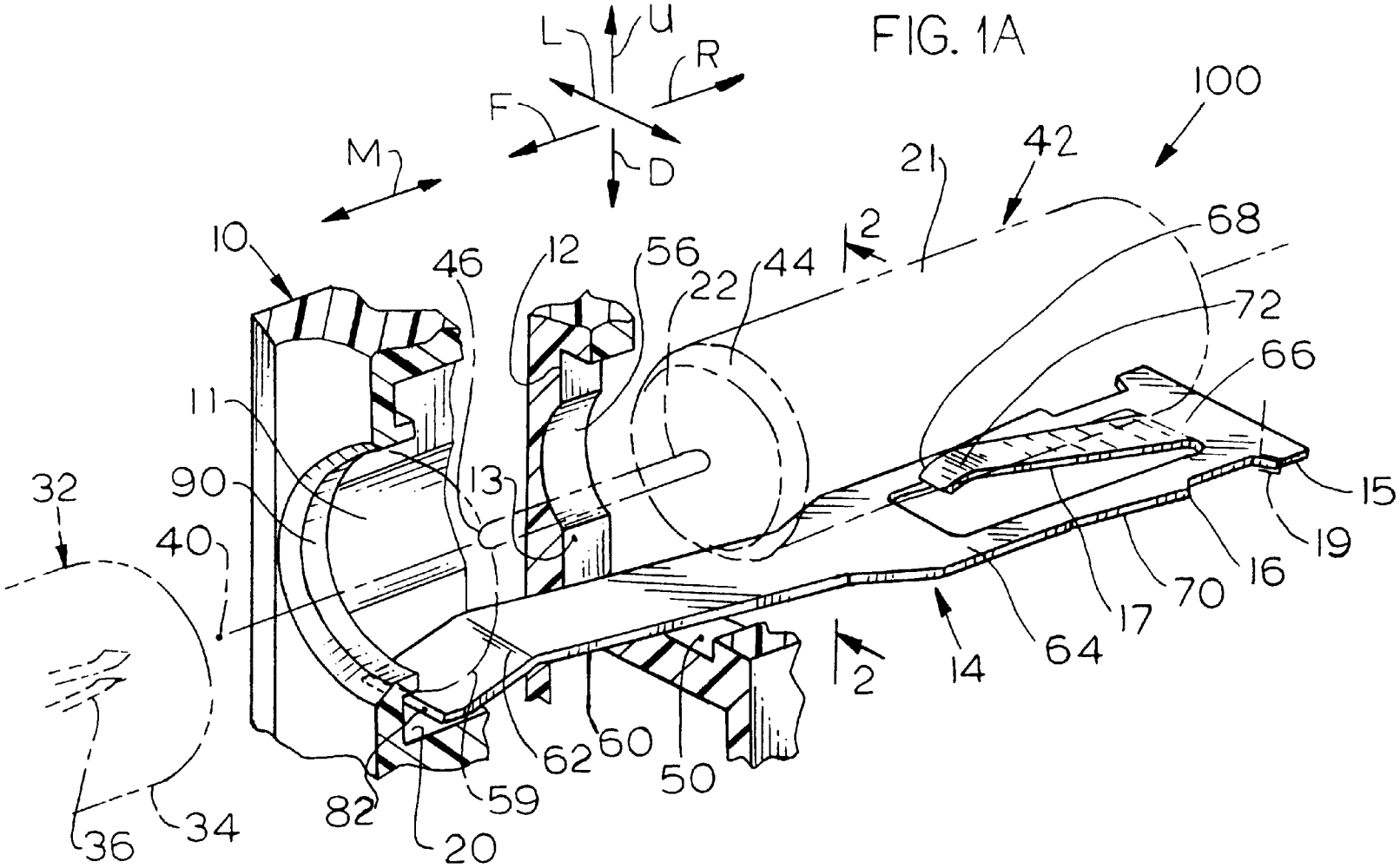
FIG. 1A is a partial sectional isometric view of a connector system of the present invention.

FIG. 1A shows a connecting system 100 of the present invention, which includes a housing 10 that forms a passageway 11 with a longitudinal axis 40 extending in front and rear directions F, R that are parallel to a longitudinal direction M. A coax unit 42 lies in the passageway, with the coax unit including outer and inner coaxial terminals 21, 22 for engaging outer and inner terminal parts 34, 36 of a mating connector device 32. The inner terminal 22 of the coax device 42 that lies within the housing, has a front end 46 that projects forward of the front end 44 of the outer terminal. A sheet metal electrically conductive first coupling element 14 lies in the passageway 11, beside the coax unit 42. The coupling element has a rear portion with a tongue 17 that presses against the outer terminal 21 of the coax unit to electrically connect to it. The coupling element has a forward portion 60 that extends forwardly F and at a radially inward incline toward the axis 40, and that has a contact location 62. The contact location 62 lies forward of the coax unit outer terminal 21, and is positioned to engage the mating outer terminal part 34 of the mating device 32 upon its rearward projection into the passageway 11. The coupling element 14 serves to electrically connect the outer terminal 21 and outer terminal part 34, and also helps to hold them in place within the passageway 11.

The coupling element 14 includes a finger 64 that extends along the entire length of the element, and the tongue 17. The tongue 17 has a merging end 66 that merges with the rear portion 70 of the finger, and has a free end 68. Although the rear portion 70 lies substantially in a plane, the tongue is bent near its merging end 66, so that the free end 68 lies considerably radially inward (with respect to axis 40) with respect to the rest of the rear portion of the coupling element. The tongue is bent so a location 72 on the tongue at its free end, can press against the outer terminal 21 of the coax unit 42.

The tongue 17 is preferably short and stiff enough, that it presses with a greater force against the outer terminal 21 than does the contact location 62 against the mating outer terminal part 34. Such difference occurs when the diameter of the mating outer terminal part 40 is the same as that of the coax unit outer terminal 21. As a result of this construction, the tongue 17 tends to keep the coax unit 42 firmly in place against "rattling" while allowing the mating device 32 to be inserted and withdrawn from the passageway 11. The contact location 62 presses with sufficient force against the mating device 32, that it establishes reliable electrical contact therewith.

The passageway 11 has opposite part cylindrical sides 56 on opposite sides of the axis, with both cylindrical sides lying on an imaginary circle 59. Top and bottom passageway extensions 12, 13 extend vertically beyond an imaginary cylinder that is coaxial with the imaginary circle 59. Each passageway extension 12, 13 extends by less than a half circle, or 180°, so the cylindrical sides 56 are left to closely position the sensor terminal 21 of the coax unit. The coupling element 14 is shown in FIG. 1A as lying primarily within the bottom passageway extension 13. The outer terminal 21 of the coax unit 42 lies closely within the part cylindrical sides 56 of the housing, so these sides locate the coax unit in lateral directions L and in up and down U, D directions. The extensions including the bottom extension 13, provide room for holding the coupling element 14, with primarily only the tongue free end 68 and contact location 62 of the coupling element projecting beyond the extension 13. It is noted that when the tongue free end 68 presses upwardly firmly against the coax unit, the rear portion or part 70 of the coupling element presses downwardly against a bottom passageway wall 50 of the bottom extension 13.

The passageway 11 extends through the entire longitudinal length of the housing 10, so there are openings at opposite ends of the passageway. A front opening 90 is circular, to provide a circular hole through which the mating device 32 can be projected. The coupling element 14 can be installed by projecting it through one of the ends of the passageway, as by projecting it rearwardly through the front opening 90, prior to insertion of the coax unit 42. As the coupling element 14 is inserted, its rear portion 70 is allowed to slide along the passageway until lugs 15 at the rear end of the coupling element enter recesses such as 19 in the housing 10. The recesses 19 hold down the lugs 15, to prevent the coupling element from tipping as downward forces are applied to the tongue free end 68 and to the contact location 62. Barbs 16 on opposite sides of the rear portion 70, can "dig" into the housing walls that extend on opposite sides of the bottom wall 50 to prevent longitudinal movement of the coupling element. The coupling element is installed so a front end 82 of the coupling element and of the finger, lies in a groove 20 at the front of the bottom extension 13, to prevent accidental rearward pushing against the coupling element front end 82.

Figure 2:
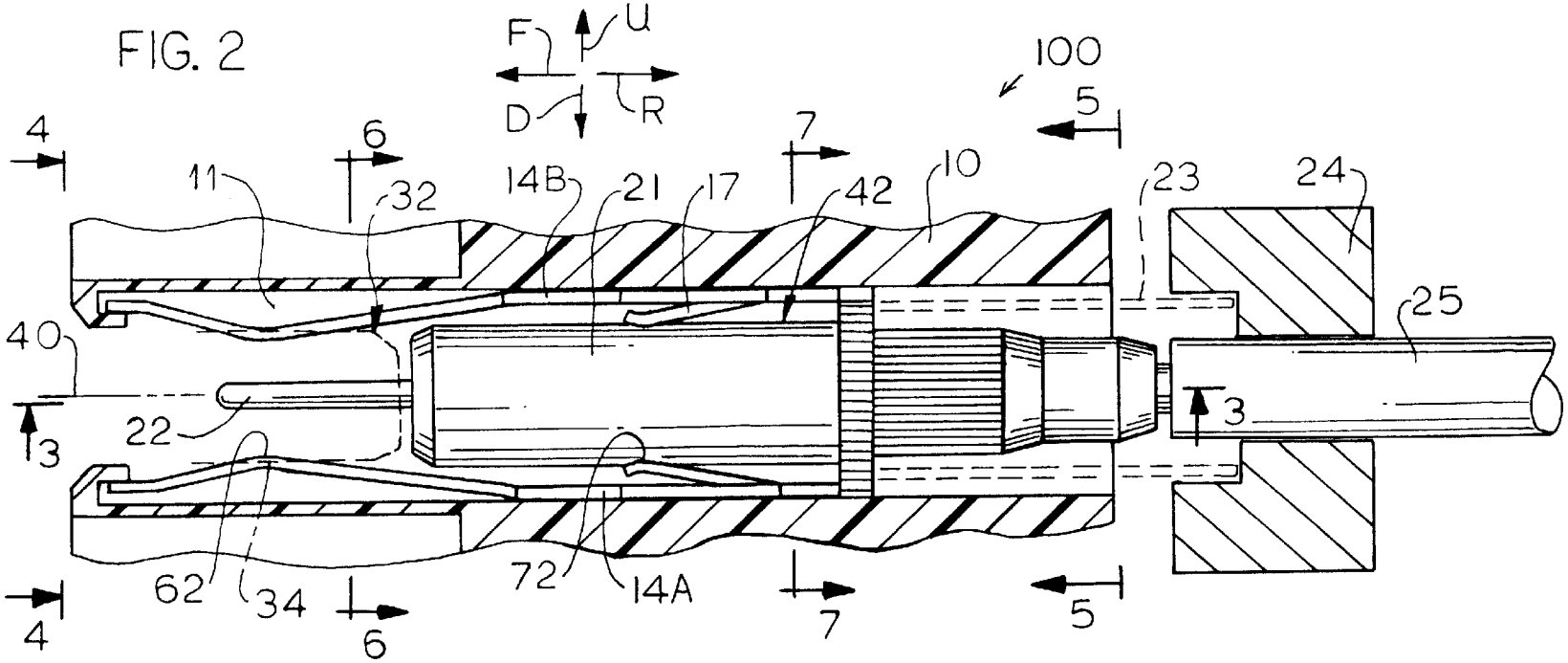
FIG. 2 is a view taken on line 2—2 of FIG. 1A.
Figure 3:
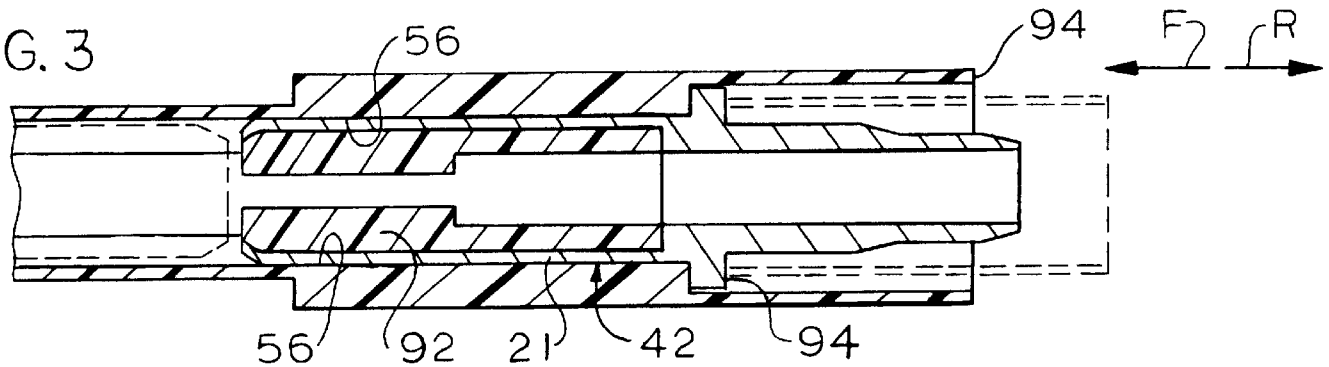
FIG. 3 is a view taken on line 3—3 of FIG. 2, but without the cable or inner coaxial conductor.

FIG. 2 shows that the connector system includes lower and upper coupling elements 14A, 14B that are preferably identical. It can be seen that the outer terminal 21 of the coax unit is trapped between the locations 72 on the tongues 17 of the lower and upper coupling elements. It also can be seen that the contact locations 62 of the elements will press against the outer terminal parts 34 of a mating device 32 that is projected into the passageway 11. FIG. 2 shows a cable 25 terminated to the coax unit 42 by a crimping sleeve 23 and held by a cap 24. FIG. 3 shows that the coax unit 42 includes an insulator 92 between the outer terminal 21 and the inner terminal (not shown in FIG. 3). The outer terminal 21 is closely held between the part cylindrical sides 56 of the passageway. The particular coax unit 42 shown is installed by moving it forwardly F into the rear end 94 of the housing.

Figure 1:
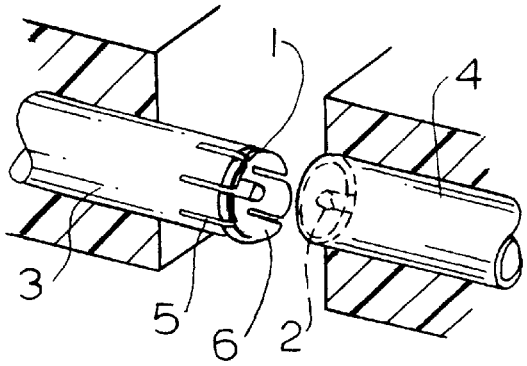
FIG. 1 PRIOR ART
FIG. 1 is an isometric exploded view of a prior art connector system.
Figure 4:
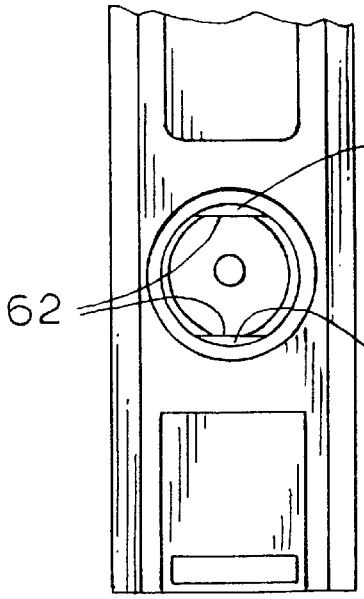
FIG. 4 is a view taken on line 4—4 of FIG. 2.
Figure 5:
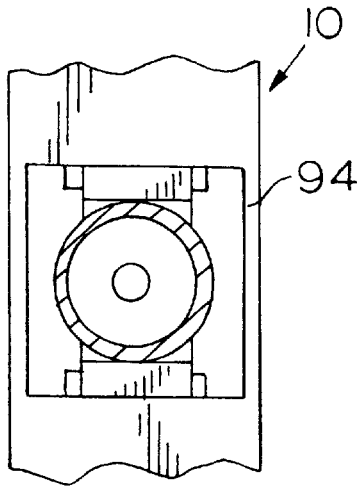
FIG. 5 is a view taken on line 5—5 of FIG. 2 without the coax unit or coupling elements in place.
Figure 6:
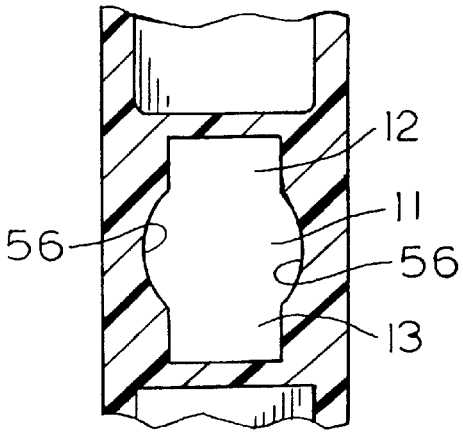
FIG. 6 is a sectional view of only the housing of the connector system, taken on line 6—6 of FIG. 2.
Figure 7:
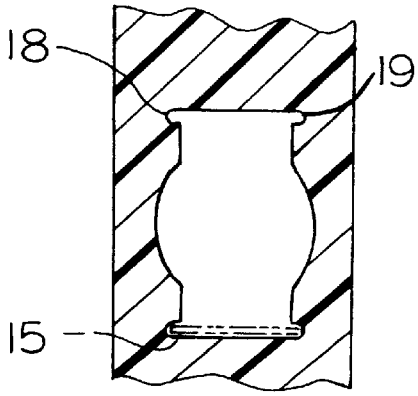
FIG. 7 is a sectional view showing only the housing of the connector system, taken on line 7—7 of FIG. 2.

FIG. 4 shows the front of the housing and the contact locations 62 of the two coupling elements 14A, 14B. FIG. 6 is a sectional view showing the part cylindrical opposite sides 56 of the housing and the top and bottom extensions 12, 13. FIG. 7 shows that the bottom and top extensions have recesses 18, 19 for receiving the lugs 15 (FIG. 1A) at the rear of the coupling elements.

Figure 11:
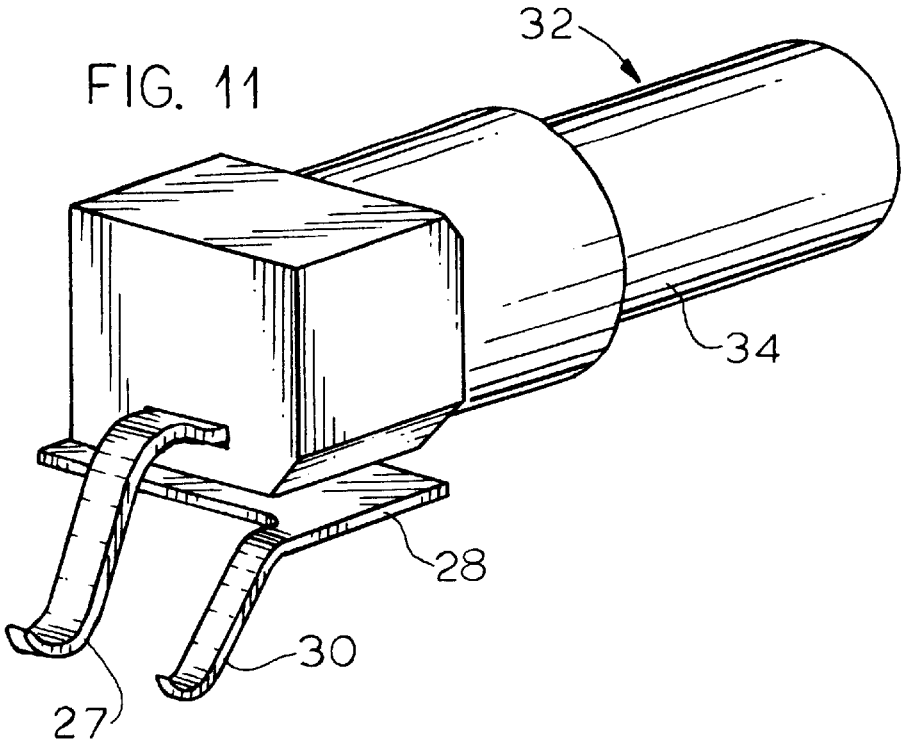
FIG. 11 is an isometric view of the mating device of FIG. 1A.
Figure 10:
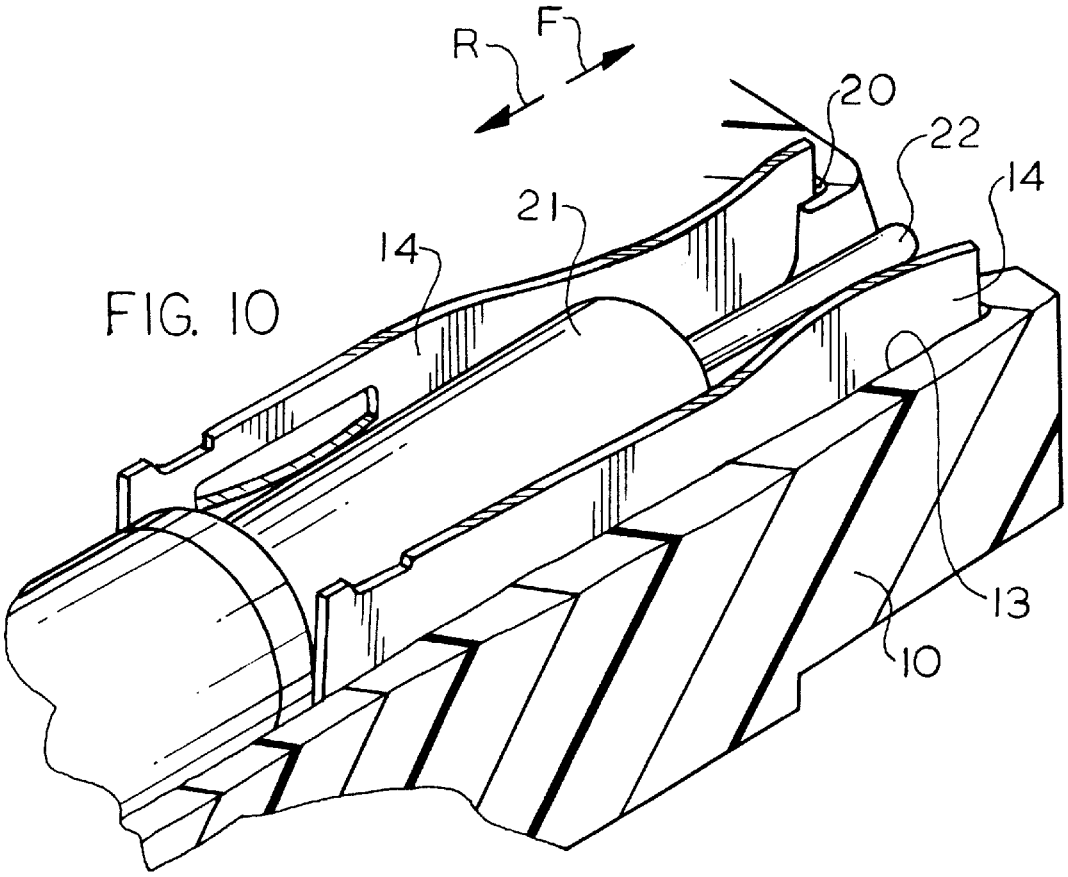
FIG. 10 is a partial sectional isometric view of the connector system of FIG. 1A.

FIG. 11 shows one mating device 32, which includes a base plate with a downward extension 30 for electrically connecting the outer terminal part 34 to a circuit board trace, and an extension 27 for connecting the coaxial inner terminal to a circuit board trace.

Figure 8:
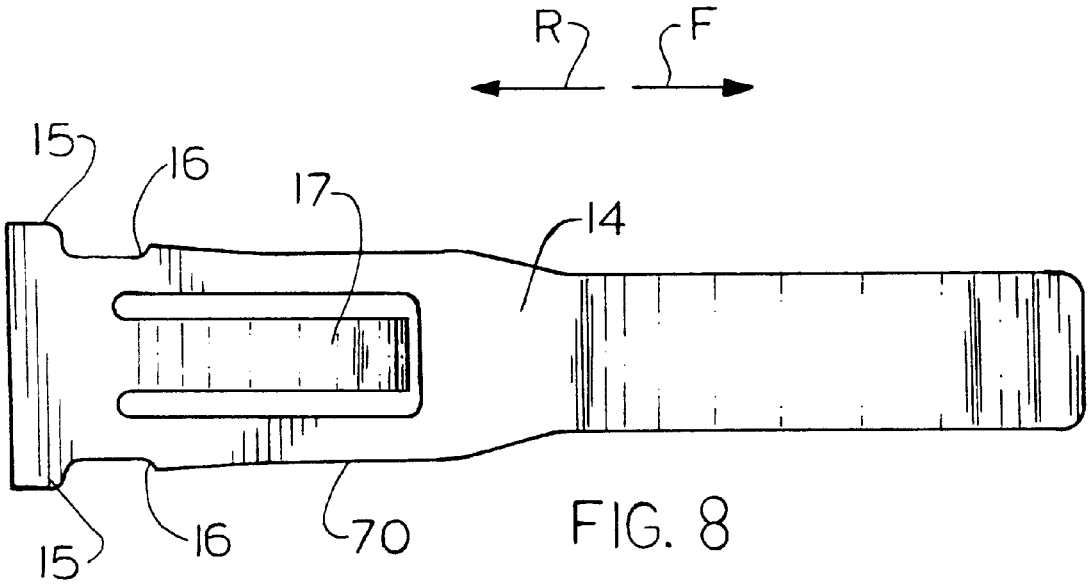
FIG. 8 is a plan view of the coupling element of FIG. 1A.
Figure 9:
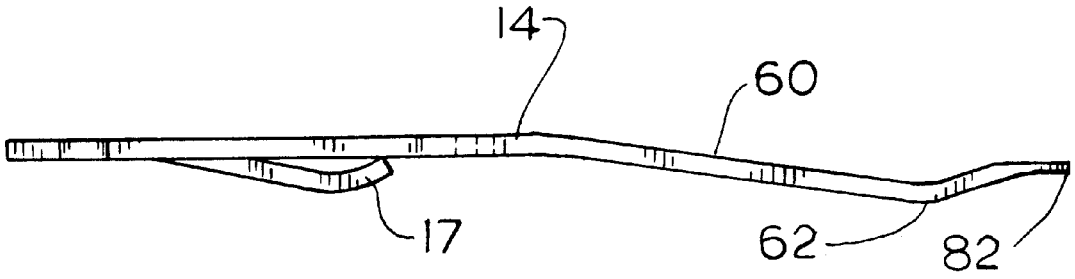
FIG. 9 is a side elevation view of the coupling element of FIG. 8.

Each of the coupling elements 14A, 14B can be stamped from a sheet of metal such as Beryllium Copper in the shape illustrated in FIG. 8. The finger forward portion 60 and tongue 17 are bent out of the plane of the rear portion 70, at an acute angle. The stamped coupling element includes the barbs 16 that can bite into the opposite sides of an extension to prevent withdrawal of the coupling unit, with the lugs 15 holding down the rear portion 70. Instead of two separate coupling elements 14A, 14B, it is possible to provide a single piece of sheet metal with two or more coupling element portions (tongues and forward portions) spaced about the axis of the passageway. Instead of forming the coupling element with one tongue 17 for engaging the coax unit and a radially inwardly bent finger front portion 60 for engaging an inserted mating device, it is possible to form tongues at both the front and rear portions of the coupling element. In that case, a tongue similar to 17, would be used to engage the mating device 72. It is also possible to eliminate the tongue 17 and to instead bend the coupling element 17 so it has a rear portion that extends at a rearward radially inward incline to engage the coax unit. It is noted that the cap 24 (FIG. 2) prevents rearward movement of the coax unit by pushing at the sleeve 23, with the sleeve pushing against flanges 94 (FIG. 3) on the coax unit. The cap 24 can screw into place on the housing. However, the tongues 17 help prevent slight forward and rearward movement, or "rattling" of the coax unit.

The housing 10 is molded, preferably from a dielectric material, and can be produced at moderate cost in large quantities. The coupling elements 14 are stamped from sheet metal and also can be produced and installed at low cost.

While terms such as "upper", "lower", etc have been used to aid in describing the system as is it is generally illustrated, it should be understood that the connector system can be used in any orientation with respect to the Earth.

Thus, the invention provides a coaxial connector system and a coaxial connector therefore, which can be constructed at low cost to reliably electrically connect the outer terminals of a pair of mating connectors or devices. One or more coupling elements are located in a passageway that holds a coax unit, with each coupling element having a rear portion that resiliently engages the outer terminal of the coax unit and having a front portion that is biased radially inwardly to resiliently engage the outer terminal part of a second connector or mating device. The passageway in a housing that receives the coax unit and one or more coupling elements, can include part cylindrical walls that closely surround the coax unit to position it in lateral and up and down directions, and can include an extension for holding a coupling element. The coupling element can include at least one tongue at its rear portion to press firmly against the coax unit to prevent it from rattling as well as to electrically connect to it. The rear of the coupling element can have a pair of lugs to hold the rear end downward so the coupling element does not tip as more forward locations engage the coax unit and a mating device.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector for connection to a mating device that includes coaxial inner and outer terminal parts, comprising:

a housing having a passageway walls forming a passageway with a longitudinal axis extending in front and rear directions;

a coax unit lying in said passageway, said coax unit including inner and outer coaxial terminals for engaging the inner and outer terminal parts of the mating device, with said outer coaxial terminal having a front end and with said inner coaxial terminal having a front end projecting forward of said outer coaxial terminal front end;

a sheet metal electrically conductive coupling element that lies partially in a passageway wall extension that extends radially outward from said passageway, with said coupling element lying beside the coax unit, said coupling element having a portion that presses against the outer coaxial terminal of said coax unit, said coupling element having a forward portion that extends at a radially inward incline toward said longitudinal axis and that has a contact location lying forward of said outer coaxial terminal of said coaxial unit, to engage the mating outer terminal part of the mating device and thereby electrically connect it to said outer coaxial terminal;

said coupling element being slidably engaged with said coax unit so said coupling element and said coax unit can be separately slid into said housing.

2. The connector described in claim 1 wherein:

said coax unit has a cylindrical exterior and said passageway has opposite part cylindrical sides that are each parts of an imaginary cylinder that closely surrounds said coax unit, and said passageway has a bottom passageway extension extending from only one side of said passageway and extending beyond from said imaginary cylinder, and with said coupling element lying primarily in said bottom passageway extension.

3. A coaxial connector for holding a coaxial unit that includes inner and outer terminals and for receiving a mating device that includes inner and outer terminal parts, comprising:

a housing having passageway walls forming a passageway with a longitudinal axis extending in front and rear directions;

said passageway having a forward portion with a cross-section that includes opposite sides that are each parts of an imaginary cylinder and top and bottom extensions that extend respectively above and below said imaginary cylinder with each extension having an end wall that lies furthest from said imaginary cylinder;

a pair of electrically conductive coupling elements that each lies primarily in a different one of said extensions, with each coupling element having a rear portion with an outer terminal-engaging part that is biased to resiliently press into said imaginary cylinder and against said outer terminal therein and with a passage wall-engaging part that presses against the end wall of the corresponding extension, with each coupling element having a front portion that extends at a forward and radially inward incline into said imaginary cylinder to press against the mating device outer terminal part when the outer terminal part is inserted into said passageway.

4. The connector described in claim 3 wherein:

each of said coupling element includes a finger and a tongue, with said tongue having one end merging with said finger and an opposite free end part, said finger extending along the full length of said coupling element and forming said coupling element front portion, and said tongue lying at said rear portion of said coupling element;

said tongue free end part extends substantially into said imaginary cylinder to press against the outer terminal of the coaxial unit.

5. The connector described in claim 3 wherein:

said housing has a front wall with an opening that is substantially circular and of substantially the same diameter as said imaginary cylinder, and said front wall blocks a majority of the cross-section of said extensions;

each of said coupling elements is of a maximum width that allows it to be inserted rearwardly completely through said opening.

6. A method for assembling a coaxial connector and mating it to a mating device, comprising:

forming a housing with a passageway front portion having opposite sides that are primarily the opposite sides of an imaginary cylinder that has an axis, and with at least one extension that extends downwardly from a bottom of the imaginary cylinder and that has an extension bottom wall, with said extension extending less than 180° about said axis to leave said opposite sides of said passageway front portion so they can locate a coaxial unit, said passageway having a front end that is primarily a circle coincident with said imaginary cylinder;

inserting at least one sheet metal coupling element with resiliently biased apart rear parts, into said extension bottom wall of said passageway front portion;

inserting the coaxial unit that includes an outer conductor into said passageway front portion, and trapping said coupling element rear parts between said coaxial unit and said extension bottom wall.

7. The method described in claim 6 wherein:

said step of insertion includes locating said coupling element so a front part thereof lies closely behind said passage front end and an outer terminal-engaging bend thereof projects into said imaginary cylinder, and said step of inserting a coaxial unit includes inserting it rearwardly so said outer conductor lies rearward of said coupling element bend.

8. A coaxial connector for connection to a mating device that includes coaxial inner and outer terminal parts, comprising:

a housing having passageway walls forming a passageway with a longitudinal axis extending in front and rear directions;

a coax unit lying in said passageway, said coax unit including inner and outer coaxial terminals for engaging the inner and outer terminal parts of the mating device, with said outer coaxial terminal having a front end and with said coaxial inner terminal having a front end projecting forward of said outer coaxial terminal front end;

a sheet metal electrically conductive coupling element that lies in said passageway beside said coax unit, said coupling element having a portion that presses against said outer coaxial terminal of said coax unit and against said passageway walls, said coupling element having a forward portion that extends at a radially inward incline toward said longitudinal axis and that has a contact location lying forward of said outer coaxial terminal of said coaxial unit, to engage the mating outer terminal part of the mating device and thereby electrically connect it to said outer coaxial terminal;

said coupling element having a rear portion and said coupling element including a tongue, with said tongue having one end merging with said coupling element rear portion and with said tongue having an opposite free end;

said tongue free end pressing against said outer coaxial terminal of said coaxial unit.

9. The connector described in claim 8 wherein:

said mating outer terminal part has a diameter;

said tongue is stiff enough that it presses with greater force against a location on said coax outer terminal than does said contact location against the mating outer terminal part, when the diameter of the mating outer terminal part is the same as that of said location on said coaxial outer terminal.

10. A coaxial connector for connection to a mating device that includes coaxial inner and outer terminal parts, comprising:

a housing having passageway walls forming a passageway with a longitudinal axis extending in front and rear directions;

a coax unit lying in said passageway, said coax unit including inner and outer coaxial terminals for engaging the inner and outer terminal parts of the mating device, with said outer coaxial terminal having a front end and with said coaxial inner terminal having a front end projecting forward of said outer coaxial terminal front end;

a sheet metal electrically conductive coupling element that lies in said passageway beside said coax unit, said coupling element having a portion that presses against said outer coaxial terminal of said coax unit and against said passageway walls, said coupling element having a forward portion that extends at a radially inward incline toward said longitudinal axis and that has a contact location lying forward of said outer coaxial terminal of said coaxial unit, to engage the mating outer terminal part of the mating device and thereby electrically connect it to said outer coaxial terminal;

said passageway has a cross-section that extends around at least part of said coax unit, with said passageway thereat having opposite part cylindrical sides that are each parts of an imaginary cylinder and with a bottom passageway extension extending beyond from said imaginary cylinder, with said outer coaxial terminal of said coaxial unit being primarily cylindrical and lying closely within said cylindrical sides, and with said first coupling element lying primarily in said bottom passageway extension;

said rear portion of said coupling element has a rear end forming sidewardly projecting lugs, with said passageway extension forming a pair of recesses and with said lugs lying in said recess.

11. The connector described in claim 10 wherein:

said rear portion of said coupling element has opposite sides that each forms a barb anchored in said extension.

* * * * *